US007639961B2

(12) United States Patent
Nishida et al.

(10) Patent No.: US 7,639,961 B2
(45) Date of Patent: Dec. 29, 2009

(54) IMAGE FORMING APPARATUS WITH MEANS OF PREVENTING BACKSIDE SOIL OF TRANSFER MATERIAL

(75) Inventors: Satoshi Nishida, Saitama (JP); Shigetaka Kurosu, Hino (JP); Kazuteru Ishizuka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 187 days.

(21) Appl. No.: 11/245,189

(22) Filed: Oct. 7, 2005

(65) Prior Publication Data

US 2006/0098999 A1 May 11, 2006

(30) Foreign Application Priority Data

Nov. 11, 2004 (JP) ..... 2004-327447

(51) Int. Cl.
*G03G 15/06* (2006.01)

(52) U.S. Cl. ..... 399/55; 399/66; 399/314

(58) Field of Classification Search ..... 399/55, 399/314, 66

See application file for complete search history.

(56) References Cited

U.S. PATENT DOCUMENTS 5,132,738 A * 7/1992 Nakamura et al. ..... 399/314
2004/0114951 A1* 6/2004 Kawagoe ..... 399/302
2005/0180767 A1* 8/2005 Ishii et al. ..... 399/66

FOREIGN PATENT DOCUMENTS

JP 2004-264646 9/2004
JP 2001-350323 11/2004

OTHER PUBLICATIONS

Office Action mailed Mar. 3, 2009 from the Japan Patent Office for Japanese Application No. 2005-193681 and English language translation thereof.

* cited by examiner

*Primary Examiner*—David M Gray
*Assistant Examiner*—Ryan D Walsh
(74) *Attorney, Agent, or Firm*—Finnegan, Henderson, Farabow, Garrett & Dunner, L.L.P.

(57) ABSTRACT

An image forming apparatus, includes: a photoreceptor on which a toner image is formed by a charging device, an image exposure device and a developing device; and a transfer section for transferring the toner image on the photoreceptor. DC bias and AC bias voltage is applied to a development roller of the developing device, and the DC bias and AC bias voltage is set to regular value for an image area on the photoreceptor, and only the AC bias voltage is changed for a non-image area on the photoreceptor.

15 Claims, 3 Drawing Sheets

IMAGE FORMING APPARATUS WITH MEANS OF PREVENTING BACKSIDE SOIL OF TRANSFER MATERIAL

This application claims priority from Japanese Patent Application Nos. 2004-327447 filed on Nov. 11, 2004, which are incorporated hereinto by reference.

BACKGROUND OF THE INVENTION

The present invention relates to an image forming apparatus capable of solving the problem of a backside soil produced on a transfer material when a toner image is transferred from a photoreceptor or an intermediate transfer member onto the transfer material.

In a conventional color image forming apparatus without depending on the intermediate transfer method or transfer material direct transfer method, each photoreceptor is kept in contact with a conveyance belt for conveying an intermediate transfer member or a transfer material. While an endless belt-like intermediate transfer member as the intermediate transfer member or a conveyance belt is in contact with the photoreceptor, each photoreceptor or developing device cannot be stopped independently. If either the photoreceptor or the belt is stopped while they are in contact with each other, the rotating member is damaged by rubbing. To prevent this damage, means are provided in such a way that each drive is stopped after the photoreceptor has been separated completely from the endless belt-like intermediate transfer member or the conveyance belt. Further, when the developing device is stopped independently of the photoreceptor, toner or carrier may deposit on the photoreceptor, depending on the potential of the photoreceptor. To prevent this, means are provided to ensure that, after the photoreceptor can be stopped, a charging device is stopped, and then the photoreceptor and the developing device are stopped. Since the developing function is constantly working, toner is transferred also in the non-image area between the image areas, and a certain amount of image fog may be transferred in some cases.

There is no problem when a secondary transfer roller for transferring from the intermediate transfer member onto paper as a transfer material P is provided with a cleaning device such as a blade or brush, because cleaning is carried out at all times. However, when there is no cleaning device to clean the secondary transfer roller, toner deposited on the non-image area between an image area and the next one is attached to the secondary transfer roller. This is transferred onto the back surface of the next sheet of paper to cause a backside soil of paper. Conversely, when a secondary transfer roller is provided, a different problem arises. To be more specific, when the blade or brush is brought into contact, the toner must be scraped off by one cleaning operation. This requires the pressure to be increased, and the speed difference to be applied in the case of brush. However, this arrangement increases the torque of the secondary transfer roller and may require use of an exclusive driving apparatus. Thus, there has been a demand for a device of stable and simple structure, capable of solving the problem of contamination of paper by toner, without requiring use of an exclusive driving apparatus.

The Patent Document 1 discloses a transfer process, wherein transfer is carried out by contact electrification without a cleaning device, and the amount of electric charge applied to a photoreceptor is changed and inputted in response to the output of an environmental status detector. Measures are taken to remove a fog in conformity to a particular environmental status, according to this disclosure. However, this Patent Document 1 is not sufficient to meet the requirements.

(Patent Document 1): Official Gazette of Japanese Patent Tokkai 2001-350323.

SUMMARY OF THE INVENTION

An object of the present invention is to solve the aforementioned problems and to provide an image forming apparatus wherein deposition of fog toner in the non-image area is prevented in the development portion upstream of the process; and transfer of toner onto the transfer roller surface caused by toner deposition on the upstream side is avoided in the downstream secondary transfer portion, with the result that there is no backside soil on the transfer material P.

The aforementioned object is achieved by any one of the following structures.

Structure 1: An image forming apparatus, wherein a toner image is formed on a photoreceptor by a charging device, an image exposure device and a developing device, and the toner image on the photoreceptor is transferred by a transfer section; wherein DC bias voltage and AC bias voltage are applied to the development roller of the developing device; and wherein the DC bias voltage and AC bias voltage are set to regular value for the image area, and only the AC bias voltage is changed for the non-image area.

Structure 2: An image forming apparatus, wherein a toner image is formed on a photoreceptor by a charging device, an image exposure device and a developing device, and the toner image on the photoreceptor is transferred by a transfer section; and wherein the bias of the transfer section applied for transfer is set to regular value for the image area, and the output is changed for the non-image area.

DETAILED DESCRIPTION OF THE PREFERRED EMBODIMENT

The following describes the preferred embodiments of the present invention, without the technical scope or terminologies of the Claims being restricted thereto. The assertive description in the embodiment of the present invention indicates the best mode, and is not intended to restrict the technical scope or terminologies of the Claims of the present invention.

Figure 1:
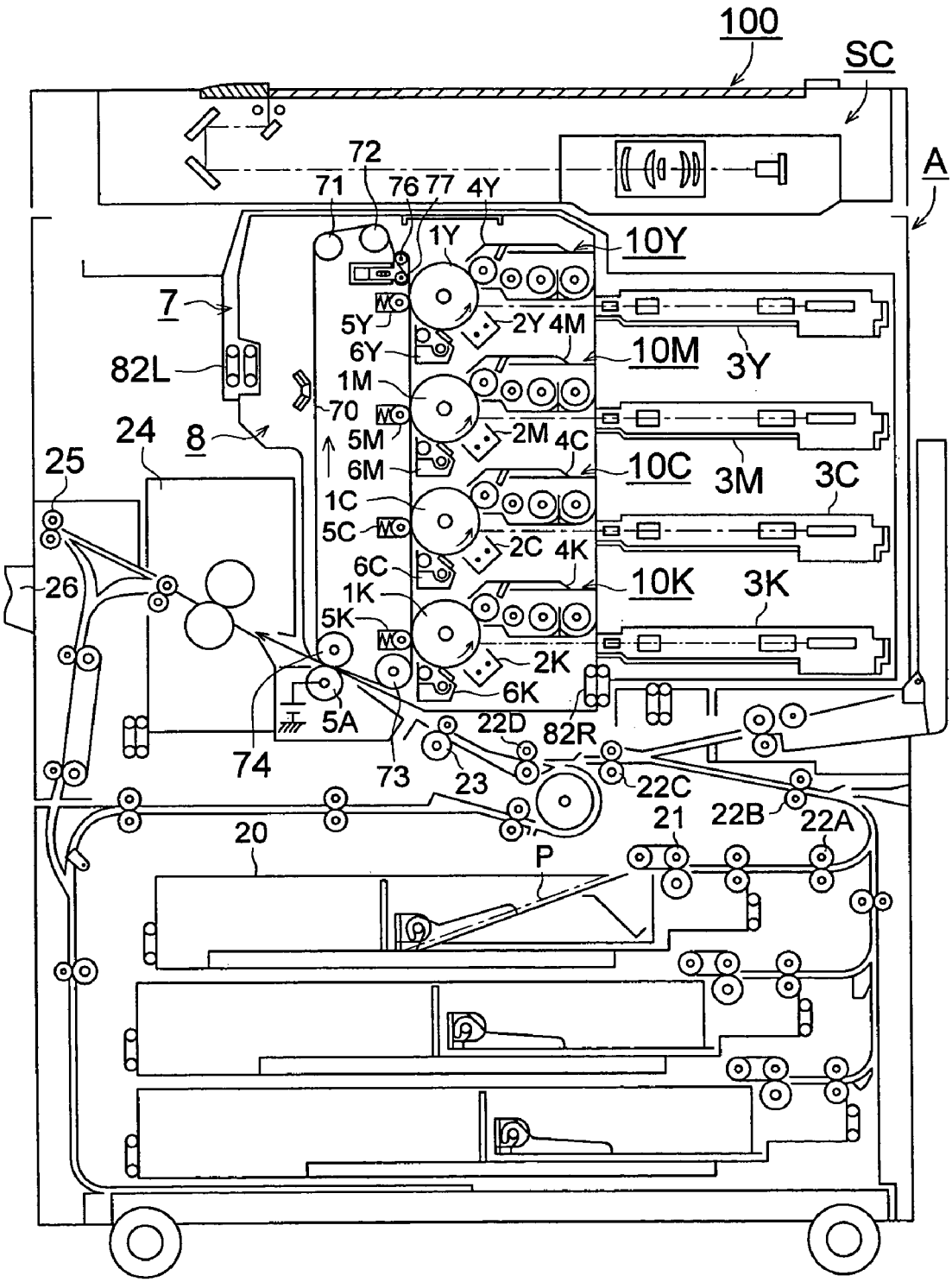
FIG. 1 is a schematic configuration diagram showing a color image forming apparatus as an embodiment of the present invention.

FIG. 1 is a schematic configuration diagram showing a color image forming apparatus as an embodiment of the present invention.

The image forming apparatus 100 is called the tandem structure full-color image forming apparatus, and is structured by plural sets of image forming sections 10Y, 10M, 10C and 10K, an endless belt type intermediate transfer unit 7 as an intermediate transfer unit, a sheet feed and conveyance section 21, and a fixing device 24. A document image reading apparatus SC is mounted on the upper portion of the image forming apparatus main body A.

The image forming section 10Y for forming a yellow image has a drum-like photoreceptor 1Y, a charging device 2Y arranged the drum-like photoreceptor 1Y, an image exposure section 3Y, a developing device 4Y, a primary transfer roller 5Y as a primary transfer unit, and a cleaning section 6Y. The image forming section 10M for forming a magenta image has a drum-like photoreceptor 1M, a charging device 2M arranged the drum-like photoreceptor 1M, an image exposure section 3M, a developing device 4M, a primary transfer roller 5M as a primary transfer unit, and a cleaning section 6M. The image forming section 10C for forming a cyan image has a drum-like photoreceptor 1C, a charging device 2C arranged the drum-like photoreceptor 1C, an image exposure section 3C, a developing device 4C, a primary transfer roller 5C as a primary transfer unit, and a cleaning section 6C. The image forming section 10K for forming a black image has a drum-like photoreceptor 1K, a charging device 2K arranged the drum-like photoreceptor 1K, an image exposure section 3K, a developing device 4K, a primary transfer roller 5K as a primary transfer unit, and a cleaning section 6K.

The endless belt type intermediate transfer unit 7 as an intermediate transfer unit is provided with an endless belt type intermediate transfer unit 70 as a semiconducting endless belt type intermediate transfer unit, which is entrained about plural rollers.

Each of color images formed by the image forming sections 10Y, 10M, 10C and 10K is sequentially transferred onto the rotary endless belt type intermediate transfer unit 70 by the primary transfer rollers 5Y, 5M, 5C and 5K, whereby a composite color image is formed by superimposition. A transfer material P such as paper as a recording medium stored in a sheet feed cassette 20 is fed by a sheet feeding section 21, and is conveyed to a secondary transfer roller 5A as a secondary transfer unit through a plurality of intermediate rollers 22A, 22B, 22C and 22D and registration roller 23. Thus, the color image is transferred onto the transfer material P collectively. Processing of fixing is applied to the transfer material P with the color image transferred thereon by the fixing device 24. The transfer material P is gripped by ejection rollers 25 and is placed in an ejection tray 26 outside the apparatus.

After the color image has been transferred onto the transfer material P by the secondary transfer roller 5A as a secondary transfer unit, the transfer material P is subjected to curvature-separation by the endless belt type intermediate transfer unit 70. Then the residual toner is removed from the endless belt type intermediate transfer unit 70 by the cleaning section 6A.

During the process of image formation, the primary transfer roller 5K is constantly kept pressed against the photoreceptor 1K. Other primary transfer rollers 5Y, 5M, 5C are pressed against the photoreceptors 1Y, 1M and 1C during the process of color-image formation.

The secondary transfer roller 5A is kept in contact with the endless belt type intermediate transfer unit 70 only when secondary transfer is carried out on the transfer material P passing through the secondary transfer roller 5A.

The frame 8 can be pulled out of the apparatus main body A through support rails 82L and 82R.

The frame 8 contains image forming sections 10Y, 10M, 10C and 10K and an intermediate transfer unit 7.

The image forming sections 10Y, 10M, 10C and 10K are arranged in series in the vertical direction. The endless belt type intermediate transfer unit 7 is arranged on the left side of the figure showing the photoreceptors 1Y, 1M, 1C, and 1K. The intermediate transfer unit 7 entrained about the rollers 71, 72, 73, 74, 76 and 77, is composed of the rotatably arranged endless belt type intermediate transfer unit 70, primary transfer rollers 5Y, 5M, 5C and 5K, and cleaning section 6A.

The image forming sections 10Y, 10M, 10C and 10K and endless belt type intermediate transfer unit 7 are integrally pulled out of the apparatus main body A by the draw-out operation of the frame 8.

A toner image is formed on the photoreceptors 1Y, 1M, 1C, and 1K by charging, exposure and development. The toner images of different color are primary transferred and superimposed on the endless belt type intermediate transfer unit 70. They are secondary transferred onto the transfer material P collectively, and are solidified and fixed in position by pressure and heating using the fixing device 24. After the toner image has been transferred onto the endless belt type intermediate transfer unit 70, the photoreceptors 1Y, 1M, 1C, and 1K are cleaned by the cleaning sections 6Y, 6M, 6C and 6K so that toner remaining on the photoreceptors subsequent to transfer is cleaned. Then the aforementioned cycle of charging exposure and development starts to perform the next step of image formation.

The image forming apparatus of the present embodiment has an OPC wherein each of the photoreceptors 1Y, 1M, 1C, and 1K has a diameter of 60 mm, a two-component developer is used as a developer, the process speed is 220 mm/s, and the endless belt type intermediate transfer unit 70 is used as an intermediate transfer member. This image forming apparatus is a tandem structure full-color image forming apparatus 100. The primary transfer roller is a SPONGE (registered trademark) roller having a diameter of 20 mm and a resistance of $1\times10^7$ Ω. Primary transfer control is provided by constant current control method.

In the present invention, the length for expansion of the theoretical image forming range in the vicinity of the front end and rear end in the sub-scanning direction is set to 2 mm. The range including this dimension is assumed as a preferable image area. This range is provided with an ample margin of safety. Without being restricted thereto, however, the image area can be the aforementioned theoretical image forming range. In the timing chart of FIG. 2, the aforementioned dimension of 2 mm is represented in terms of time-based expansion range.

In the present invention, the DC bias voltage applied to the developing device provides a steady output in both the image area and non-image area. The AC bias voltage has a constant output value for the image area, and the output value is changed for the non-image area. This change is preferably made in the direction of reduction, and is more preferably zero.

The charging device charges the photoreceptor at a predetermined output. This charging device performs charging operation by maintaining a predetermined output during the execution of an image formation job.

As shown in FIG. 1, a transfer section is constituted by a primary transfer unit and a secondary transfer unit in some cases, while it is constituted by only one transfer section.

In the primary transfer step, bias is applied to a single layer semiconducting roller of sponge material, wherein a constant current is applied. A regular output value is used for the image area, while a value smaller than the regular output value, not zero, is used for the non-image area.

In the step of secondary transfer, the endless belt type intermediate transfer unit 70 and transfer material P are sandwiched between the secondary transfer roller 5A and the backup roller 74. Both the secondary transfer roller 5A and backup roller 74 are composed of semiconducting solid rubbers whose surfaces are provided with a surface coating layer. The core of the backup roller 74 is grounded, and bias is applied to the secondary transfer roller 5A. A constant current application method is utilized. For application of bias to the secondary transfer roller 5A, a regular value is assigned to the image area. However, there is no difference between the cases where a value smaller than the regular value is applied to the non-image area, and where the regular value is applied thereto.

In the transfer section containing the primary transfer unit and the secondary transfer unit, a transfer bias can be applied to at least the primary transfer unit when an output change has been made to the non-image area, particularly when the output has been reduced.

Figure 2:
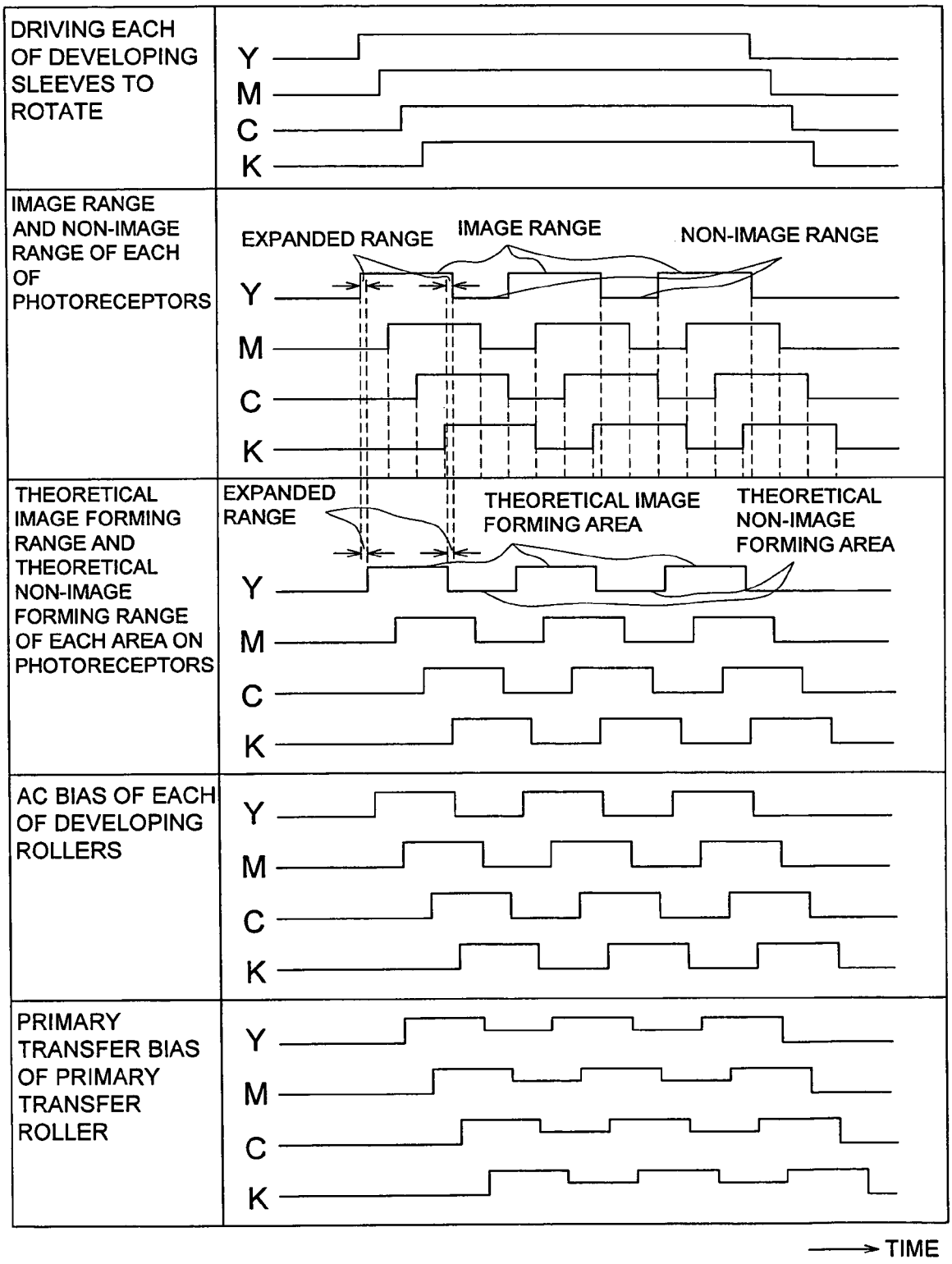
FIG. 2 is an operation diagram showing the photoreceptor image area and non-image area, the output control of the alternating current bias voltage of a developing device, and the output control of the primary transfer bias.

FIG. 2 is an operation diagram representing the photoreceptor image area and non-image area, the output control of the alternating current bias voltage of a developing device, and the output control of the primary transfer bias.

Figure 3:
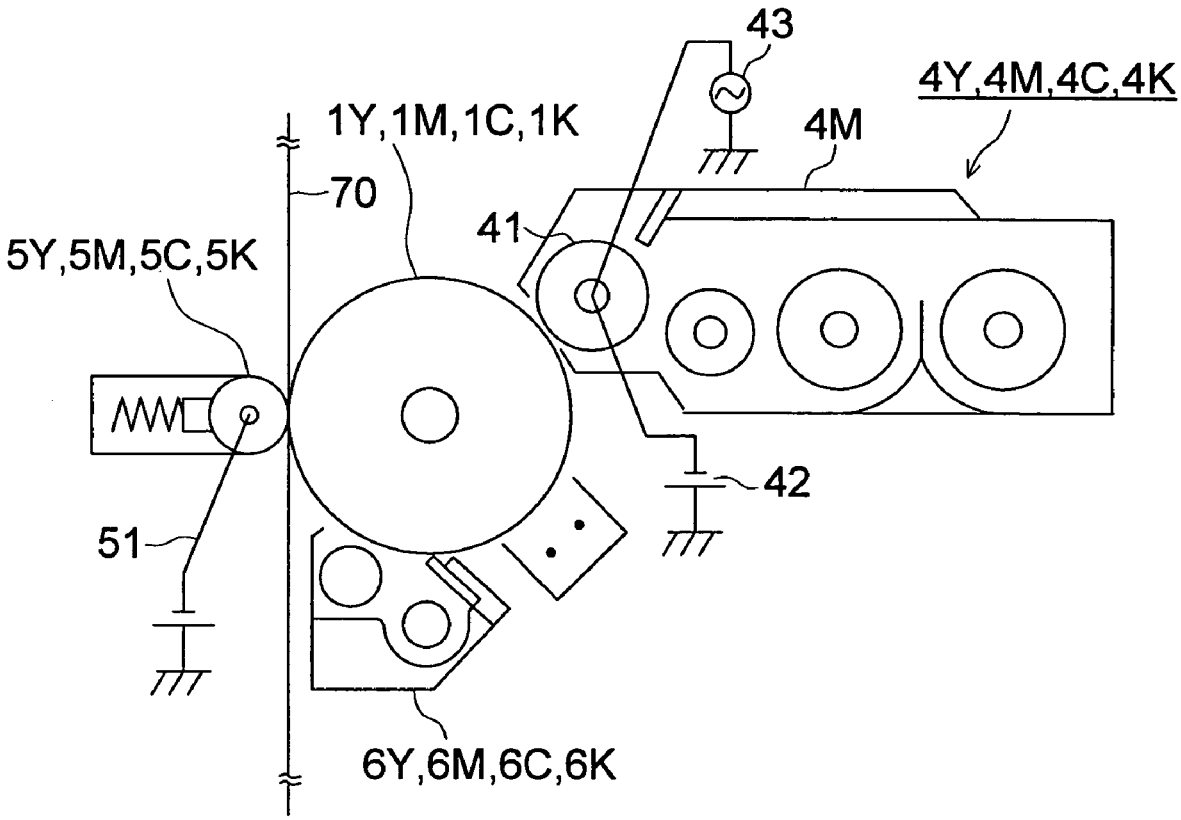
FIG. 3 is an enlarged view of the image forming apparatus.

As illustrated in the enlarged view of the image forming sections 10Y, 10M, 10C and 10K given in FIG. 3, and the operation diagram of FIG. 2, the output of the AC bias voltage 43 of the developing roller 41 for the non-image area is zero in the present invention, but it can be kept at a level greater than zero but smaller than the regular value. The primary transfer application bias 51 of the primary transfer rollers 5Y, 5M, 5C and 5K is reduced to a value smaller than the regular output, without being zero. As shown in FIG. 3, the development bias voltage applied to the developing rollers 41 of the developing devices 4Y, 4M, 4C and 4K is direct current bias voltage 42 and alternating current bias voltage 43. The regular direct current bias voltage 42 is applied for the non-image area as well as for the image area. For the non-image area, however, the alternating current bias voltage is changed form regular output value; it is reduced form the regular value or is reduced to zero.

It is also possible to arrange such a configuration that a conveyance belt is used as the transfer section, instead of the endless belt type intermediate transfer unit 70 shown in FIG. 1, and the transfer material is conveyed thereon in synchronization (not illustrated), whereby the image is transferred onto the transfer material by one transfer section. Further, other conveyance section can be provided instead of the conveyance belt.

The aforementioned non-image area is located between image areas arranged in the plural. Each of the image areas corresponds to the non-image area of the aforementioned job, and the non-image area corresponds to the non-image area of the job.

EMBODIMENT

Using the image forming apparatus of the present invention, a test was conducted to see if backside soil occurred on a transfer material.

In the first and second embodiments of the present invention, and the first, second and third comparative examples, the AC bias voltage and DC bias voltage of the developing roller 41, charging output, and primary transfer output (applied bias) were set to the regular value, were reduced from the regular value, or were set to zero for the non-image area and image area. Under these conditions, 200,000-copy durability tests were conducted to check for occurrence of backside soil, scratches of the photoreceptor caused by deposition of carrier and the consumption of toner. Table 1 shows the results of these tests.

In the aforementioned 200,000-copy durability tests, A4-sized copy samples were obtained for each of the 0-th, 50,000-th, 100,000-th, 150,000-th and 200,000-th copies, and were inspected to check for the presence or absence of a backside soil on the leading and trailing edges of the sheets as the transfer material P. "A" indicates the absence of backside soil that may cause inconvenience in practical use, "C" shows the presence of any slightest conspicuous backside soil, and "B" represents difficulty in evaluation. This check was conducted by visual inspection.

TABLE 1-1

| | Conditions | | | | | | | | Result | | |
|---|---|---|---|---|---|---|---|---|---|---|---|
| | AC bias for development | | DC bias for development | | Charging output | | Primary transfer output | | Backside | Damage of photo-receptor | |
| | Image area | Non-image area | Image area | Non-image area | Image area | Non-image area | Image area | Non-image area | soil of transfer material | caused by carrier deposition | Toner consumption |
| Embodiment 1 of the present invention | Regular value (1 kV peak-to-peak) ON | Zero OFF | Regular value ON | Regular value ON | Regular value (700 μA) ON | Regular value (700 μA) ON | Regular value (35 μA) ON | A value reduced from regular value (5 μA) ON | A | A | A |
| Embodiment 2 of the present invention | Regular value (1 kV peak-to-peak) ON | A value reduced from regular value ON | Regular value ON | Regular value ON | Regular value (700 μA) ON | Regular value (700 μA) ON | Regular value (35 μA) ON | A value reduced from regular value (5 μA) ON | A | A | A |
| Comparative example 1 | Regular value (1 kV peak-to-peak) ON | Regular value (1 kV peak-to-peak) ON | Regular value ON | Regular value ON | Regular value (700 μA) ON | Regular value (700 μA) ON | Regular value (35 μA) ON | A value reduced from regular value (35 μA) ON | C | A | B |

TABLE 1-2

| | Conditions | | | | | | | | Result | | |
|---|---|---|---|---|---|---|---|---|---|---|---|
| | AC bias for development | | DC bias for development | | Charging output | | Primary transfer output | | Backside | Damage of photo-receptor | |
| | Image area | Non-image area | Image area | Non-image area | Image area | Non-image area | Image area | Non-image area | soil of transfer material | caused by carrier deposition | Toner consumption |
| Comparative example 2 | Regular value (1 kV peak-to-peak) ON | Zero OFF | Regular value ON | Zero OFF | Regular value (700 μA) ON | Regular value (700 μA) ON | Regular value (35 μA) ON | A value reduced from regular value (5 μA) ON | B | C | B |
| Comparative example 3 | Regular value (1 kV peak-to-peak) ON | Zero OFF | Regular value ON | Zero OFF | ON/OFF in response to DC bias for develop-ment | ON/OFF in response to DC bias for develop-ment | Regular value (35 μA) ON | A value reduced from regular value (5 μA) ON | B | A | C |

In the first embodiment of the present invention, the AC bias voltage of the developing roller 41 was turned on at the regular value (1 kV peak-to-peak) for the image area, and was turned off (zero) for the non-image area. The DC bias voltage for development was turned on at the regular value (a value determined by stabilization control) in both the image and non-image areas. The charging output was turned on a the regular value (700 μA) uniformly in both the image and non-image areas. The primary transfer output (applied bias output) was turned on at the regular value (35 μA) for the image area, and was applied at a value reduced from the regular value for the non-image area. No backside soil or scratches of the photoreceptor caused by carrier deposition was found to have occurred. Further, the toner consumption was normal.

In the second embodiment of the present invention, the AC bias voltage for development was turned on at the regular value (1 kV peak-to-peak) for the image area. For the non-image area, it was not turned off at zero. A test was conducted when reduced to a value lower than the regular value. Almost the same satisfactory result as that in the above test was obtained.

Comparative first example represents the test wherein the AC and DC bias voltage of the developing roller 41, charging output and primary transfer output (applied bias) were kept turned on at the regular value uniformly in both the image and non-image areas. In this test, the AC bias voltage caused development of even the toner having a fine particle size for the non-image area. Thus, the photoreceptor was fogged, and the fogged toner in the non-image area was subjected to primary transfer. This was further subjected to the secondary transfer, with the results that backside soil occurred on the transfer material. For the image area, the toner having a smaller particle size was developed, but it was fixed in the image so that there was not problem. In any case, this caused an increase in the amount of toner to be consumed.

In the second comparative example, the AC bias voltage of the developing roller 41 was turned on at the regular value for the image area, and was turned off at zero for the non-image area. The DC bias voltage for development was turned on at the regular value for the image area, and was turned off at zero for the non-image area. The charging output was turned on at the regular value uniformly in both the image and non-image areas. The primary transfer output (applied bias output) was turned on at the regular value for the image area. For the non-image area, it was applied at a value reduced from the regular value. In the non-image area, deposition of the developer approximately including the carrier occurred. Thus, the photoreceptor was scratched by the carrier, and the developer containing the carrier was attached to the intermediate transfer member and secondary transfer roller. The carrier and toner were attached onto the transfer material, with the result that backside soil occurred.

In the third comparative example as compared to the second comparative example, the charging output was turned on at the regular value of the DC bias voltage for development or was turned off at zero. In response to this arrangement, on-and-off operation was performed. This was the difference from the second comparative example. Charging and DC bias voltage for development was subjected to on-and-off operation due to a certain level of phase difference. If the developer including the carrier deposited in this case, the photoreceptor was damaged. Accordingly, this arrangement was avoided, and setting was applied to the sequence wherein deposition of fog toner occurred. This caused toner consumption in the non-image area, and a certain amount of backside soil was produced on the transfer material by that toner.

In the comparative examples, backside soil was observed in the initial phase of the test. By contrast, in the embodiments of the present invention, no backside soil was observed throughout the 200,000-copy test.

The present invention solves the problem of backside soil being produced on the transfer material P, without the need of installing mounting a cleaning mechanism on the secondary transfer roller 5A, and simplifies the mechanism of the secondary transfer unit, thereby providing an image forming apparatus characterized by excellent maneuverability.

The aforementioned embodiments refer to the transfer section containing both the first transfer unit and the second transfer unit given in FIG. 1. It is possible to provide an image forming apparatus based on the method wherein a conveyance belt is used as the transfer section, instead of the endless belt type intermediate transfer unit 70 shown in FIG. 1, and a transfer material is fed thereon (not illustrated) in synchronization, so that transfer is carried out on the transfer material P by one transfer section. Transfer bias is applied to this transfer section under the same conditions as those of the aforementioned primary transfer unit in both the image area and non-image area. Further, the same test as the above was conducted on the DC and AC bias voltage for development and charging output under the same conditions as those of the first and second embodiments. The results was as good as that of the above tests.

In an image forming apparatus for forming a single color image without using the step of multi-color image superposition, the AC bias voltage for developing roller 41, DC bias voltage for development, charging output and transfer output (applied bias) were tested under almost the same condition as those of the first and second embodiments in the image and non-image areas. Neither backside soil nor scratch of the photoreceptor caused by the carrier deposition was observed. The toner consumption was normal.

In the image forming apparatus of the aforementioned structure according to the present invention, the secondary transfer roller is not provided with a cleaning section, and primary transfer output is reduced outside the image area, namely, inside the non-image area, and the AC bias voltage output in the development bias voltage is reduced below the regular value or is turned off. This arrangement of the image forming apparatus solves the problem of the backside soil of the transfer material being produced by the fog toner on the intermediate transfer member, and the problem of the photoreceptor being damaged by carrier deposition. It also solves the problem of the amount of toner consumption being increased by the fog, with the result that a stable, high-quality and clean print image is provided by the aforementioned arrangement of the present invention.

The present invention further provides a simplified structure, a reduced manufacturing cost and enhanced maneuverability because the secondary transfer roller need not be provided with a cleaning unit.

The above examples show the case of an image forming apparatus equipped with a transfer section composed of a primary transfer unit and a secondary transfer unit. In addition to this arrangement, an image forming apparatus equipped with a transfer section composed of one transfer unit capable of completing the transfer job also provides the advantages of solving the problem of backside soil produced on the transfer material, the problem of the photoreceptor being scratched by deposition of carrier, and the problem of the amount of toner consumption being increased.

What is claimed is:

1. An image forming apparatus, comprising:

(a) a photoreceptor on which a toner image is formed by a charging device which charges both an image area and a non-image area on the photoreceptor in a rotation direction thereof so that a surface potential of the photoreceptor is maintained at a predetermined value in both the image and non-image areas during an execution of an image formation job, an image exposure device and a developing device; and (b) a transfer section for transferring the toner image on the photoreceptor, wherein DC bias and AC bias voltage is applied between a development roller of the developing device and a grounded base of the photoreceptor, wherein the DC bias and AC bias voltage is set to a prescribed value for the image area on the photoreceptor, and only the AC bias voltage is changed for the non-image area on the photoreceptor, wherein an exposure operation of the image exposure device to the non-image area on the photoreceptor is not carried out before a developing operation is conducted, and wherein the charging device charges both the image area and the non-image area at a predetermined output.

2. The image forming apparatus of claim 1, wherein the AC bias voltage is set to zero for the non-image area.

3. The image forming apparatus of claim 1, wherein the AC bias voltage is reduced from the prescribed value for the non-image area.

4. The image forming apparatus of claim 1, wherein the bias voltage of the transfer section applied for transfer is set to the prescribed value for the image area, and the output is changed for the non-image area.

5. The image forming apparatus of claim 1, wherein the non-image area is located between adjacent image areas of a plurality of the image areas.

6. The image forming apparatus of claim 1, wherein the image area corresponds to a plurality of images formed in at least one job, and the non-image area corresponds to the non-image area in the at least one job.

7. The image forming apparatus of claim 6, wherein the charging device charges while maintaining a predetermined output in the at least one job.

8. The image forming apparatus of claim 1, further comprising an intermediate transfer member for carrying the toner image, and the transfer section transfers the toner image onto the intermediate transfer member.

9. The image forming apparatus of claim 8, wherein the transfer section comprises a primary transfer unit for transferring the toner image onto the intermediate transfer member, and a secondary transfer unit for transferring the toner image onto a transfer material from the intermediate transfer member.

10. The image forming apparatus of claim 9, wherein the secondary transfer unit comprises a secondary transfer roller capable of coming in pressure contact with the intermediate transfer member.

11. The image forming apparatus of claim 9, wherein the primary transfer unit changes the prescribed value for the non-image area, while the secondary transfer unit does not change the prescribed value for the non-image area.

12. The image forming apparatus of claim 1, wherein the transfer section transfers the toner image directly onto the transfer material from the photoreceptor.

13. The image forming apparatus of claim 12, wherein the transfer section comprises a conveyance belt for conveying the transfer material, and transfers the toner image directly onto the transfer material on the conveyance belt.

14. The image forming apparatus of claim 1, comprising a plurality of the developing devices for each color, and forms a color image that is composed of each of toner images on the intermediate transfer member or the transfer material.

15. The image forming apparatus of claim 1, comprising a plurality of the transfer sections for each color, and forms a color image that is composed of each of toner images on the intermediate transfer member or the transfer material.

* * * * *